US009308460B1

(12) United States Patent
Chin

(10) Patent No.: US 9,308,460 B1
(45) Date of Patent: Apr. 12, 2016

(54) COMBINATION SLIDE

(71) Applicant: T. K. CHIN COMPANY LTD., Taipei (TW)

(72) Inventor: Howard Chin, Taipei (TW)

(73) Assignee: T.K. CHIN COMPANY LTD., Taipei (TW)

( * ) Notice: Subject to any disclaimer, the term of this patent is extended or adjusted under 35 U.S.C. 154(b) by 0 days.

(21) Appl. No.: 14/631,463

(22) Filed: Feb. 25, 2015

(30) Foreign Application Priority Data

Dec. 8, 2014 (TW) ..... 103142693 A

(51) Int. Cl.
*A63G 21/04* (2006.01)
*A63B 9/00* (2006.01)

(52) U.S. Cl.
CPC ..... *A63G 21/04* (2013.01)

(58) Field of Classification Search
CPC ..... A63G 21/00; A63G 21/04; A63G 21/16; A63B 1/00; A63B 1/005; A63B 9/00
USPC ..... 472/13, 116, 117; 104/53, 69, 70
See application file for complete search history.

(56) References Cited

U.S. PATENT DOCUMENTS

| | | | | |
|---|---|---|---|---|
| 2,189,691 | A * | 2/1940 | Travers | A63G 21/00 472/116 |
| 2,270,909 | A | 1/1942 | Spizer | |
| 2,839,299 | A * | 6/1958 | Weiss | A63B 1/005 297/118 |
| 4,943,048 | A | 7/1990 | Hentges | |
| 5,197,924 | A | 3/1993 | Gerrells | |
| 5,427,574 | A | 6/1995 | Donnelly-Weide | |
| 8,771,093 | B2 | 7/2014 | Bowen | |
| 2013/0281221 | A1 | 10/2013 | Bowen | |

FOREIGN PATENT DOCUMENTS

TW M433901 U1 7/2012

* cited by examiner

*Primary Examiner* — Kien Nguyen
(74) *Attorney, Agent, or Firm* — Birch, Stewart, Kolasch & Birch, LLP

(57) ABSTRACT

A combination slide has a slide body and two pressing rods. The slide body has a head member, a tail member and multiple connecting members. The head member has a head quick-release engaging element. The tail member has a tail quick-release engaging element. Each connecting member has an upper intermediate quick-release engaging element engaged detachably with the head quick-release engaging element and a lower intermediate quick-release engaging element engaged detachably with the tail quick-release engaging element of the tail member or the upper intermediate quick-release engaging element of an adjacent connecting member. The combination slide can be quickly assembled or disassembled.

10 Claims, 9 Drawing Sheets

COMBINATION SLIDE

BACKGROUND OF THE INVENTION

1. Field of the Invention

The present invention relates to a slide, and more particularly to a combination slide that has a slide body and a pressing rod such that the combination slide may be mounted in different types of staircases.

2. Description of Related Art

Slides are set outdoors in parks, schools or playgrounds for children to play thereon. However, some parents worry about safety of their children playing outside. Therefore, a conventional combination slide has been developed for children to play the with the combination slide indoors. The conventional combination slide may be disassembled into several components for storage.

However, components of the conventional combination slide are connected by complicated manners and therefore disadvantage assembling and disassembling thereof. Furthermore, width of the conventional combination slide is constant and cannot fit all widths of staircases. When the width of the conventional combination slide is less that of a staircase, the conventional combination slide cannot be mounted securely on the staircase and easily slips laterally, which results in safety problems.

To overcome the shortcomings, the present invention provides a combination slide to mitigate or obviate the aforementioned problems.

SUMMARY OF THE INVENTION

The main objective of the invention is to provide a combination slide that has a slide body and a pressing rod such that the combination slide may be mounted in different types of staircases.

A combination slide has a slide body and two pressing rods. The slide body has a head member, a tail member and multiple connecting members. The head member has a head quick-release engaging element. The tail member has a tail quick-release engaging element. Each connecting member has an upper intermediate quick-release engaging element engaged detachably with the head quick-release engaging element and a lower intermediate quick-release engaging element engaged detachably with the tail quick-release engaging element of the tail member or the upper intermediate quick-release engaging element of an adjacent connecting member. The combination slide can be quickly assembled or disassembled.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
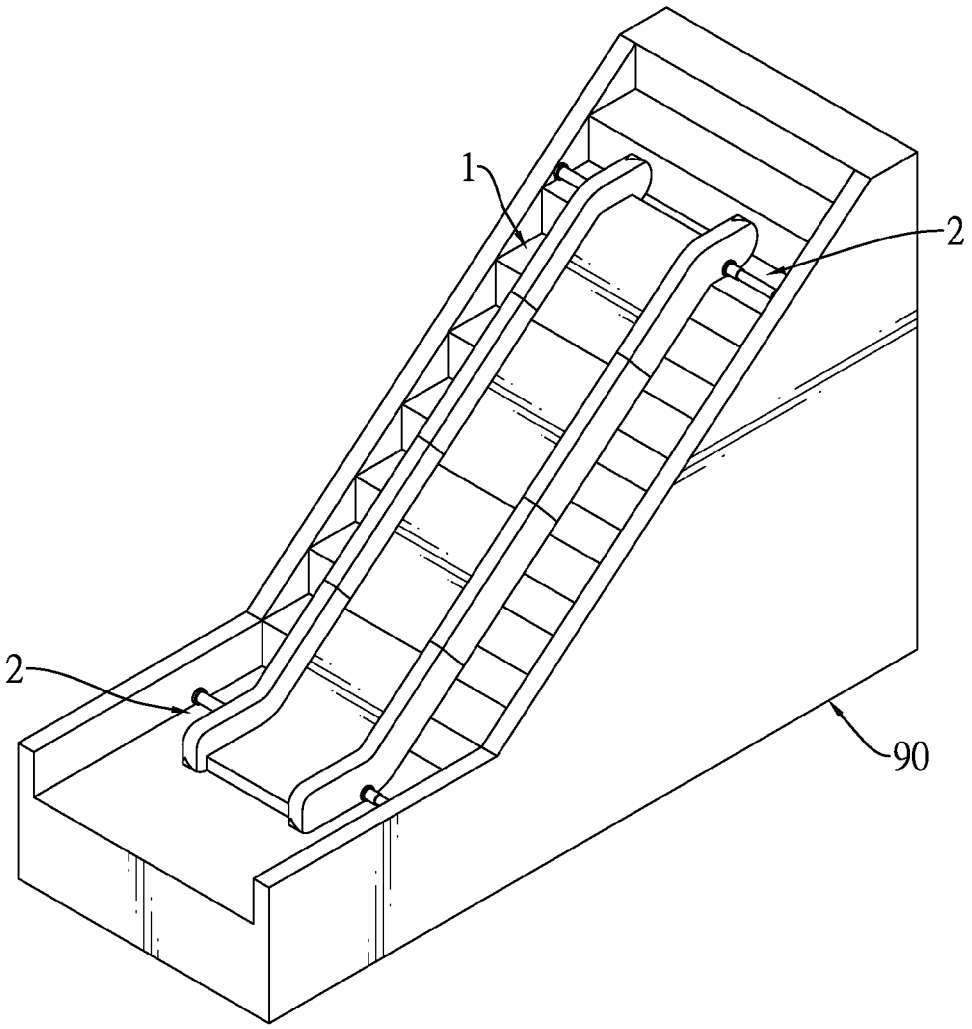
FIG. 1 is a perspective view of a first embodiment of a combination slide in accordance with the present invention set on a staircase.
Figure 2:
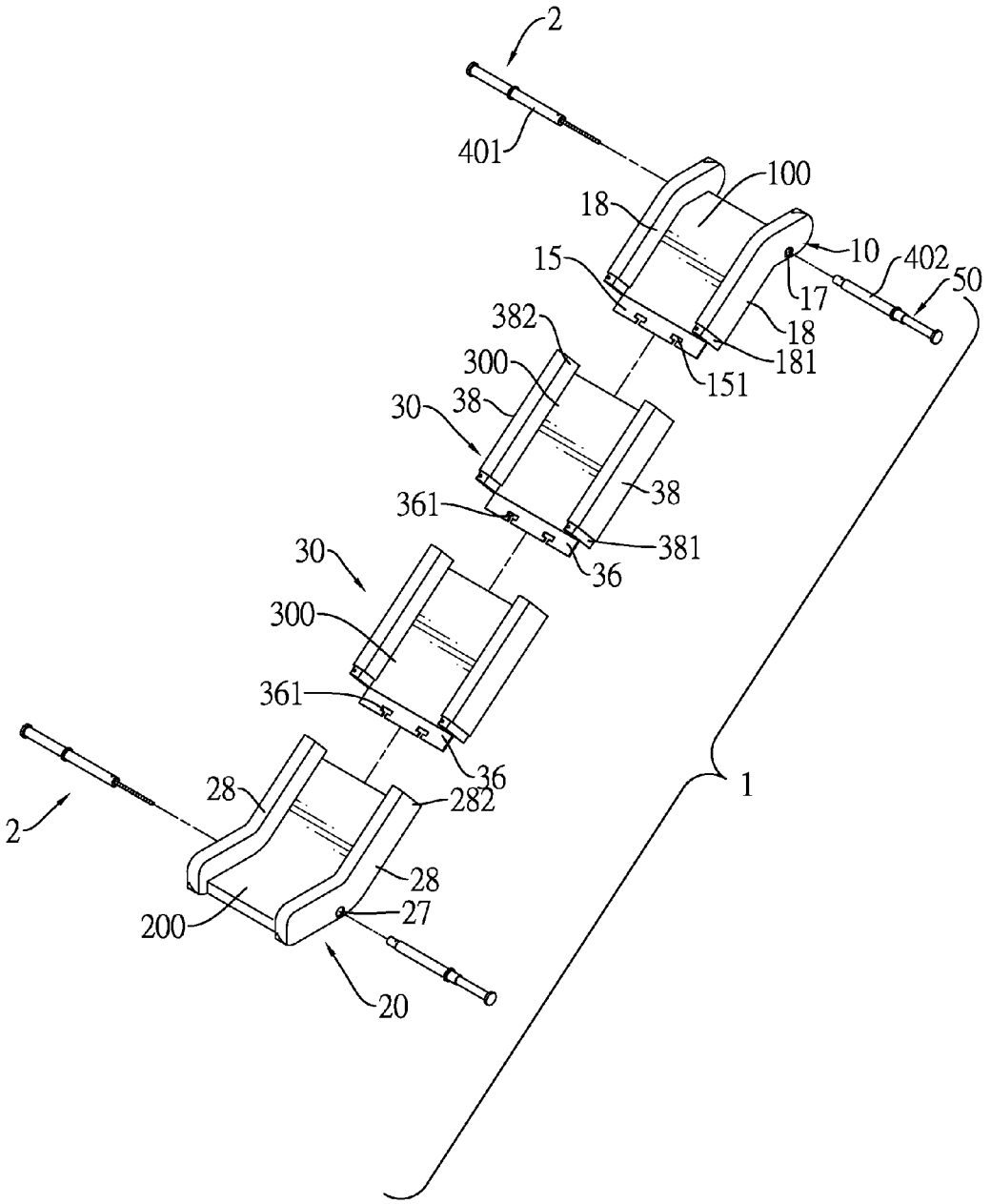
FIG. 2 is an exploded perspective view of the combination slide in FIG. 1.

With reference to FIGS. 1 and 2, a first embodiment of a combination slide in accordance with the present invention is set on a staircase 90 and comprises a slide body 1 and two pressing rods 2.

The slide body 1 is capable of being disassembled and has a head member 10, a tail member 20 and multiple connecting members 30.

The head member 10 has a head sliding channel 100, two head rails 18, two head mounting notches 181, a head quick-release engaging element 15 and an upper assembling hole 17.

The head sliding channel 100 is defined in the head member 10.

The head rails 18 are formed respectively on opposite sides of the head member 10 such that the head sliding channel 100 is located between the head rails 18.

The head mounting notches 181 are U-shaped and are defined respectively on top ends of the head rails 18.

The head quick-release engaging element 15 is formed on a bottom end of the head member 10, may be a protruding portion and has multiple T-shaped engaging slots 151 defined through the head quick-release engaging element 15.

The upper assembling hole 17 is defined laterally through the head member 10.

The tail member 20 has a tail sliding channel 200, two tail rails 28, two tail mounting protrusions 282, a tail quick-release engaging element 25 and a lower assembling hole 27.

The tail sliding channel 200 is defined in the tail member 20.

The tail rails 28 are formed on the tail member 20 so that the tail sliding channel 200 is located between the tail rails 28.

The tail mounting protrusions 282 are U-shaped and are formed on and protrude respectively from top ends of the tail rails 28.

The tail quick-release engaging element 25 is formed on a top end of the tail member 20, may be a recess portion corresponding to the protruding portion and has multiple T-shaped projections 251 formed on the tail quick-release engaging element 25.

The lower assembling hole 27 is defined laterally through the tail member 20.

Figure 3:
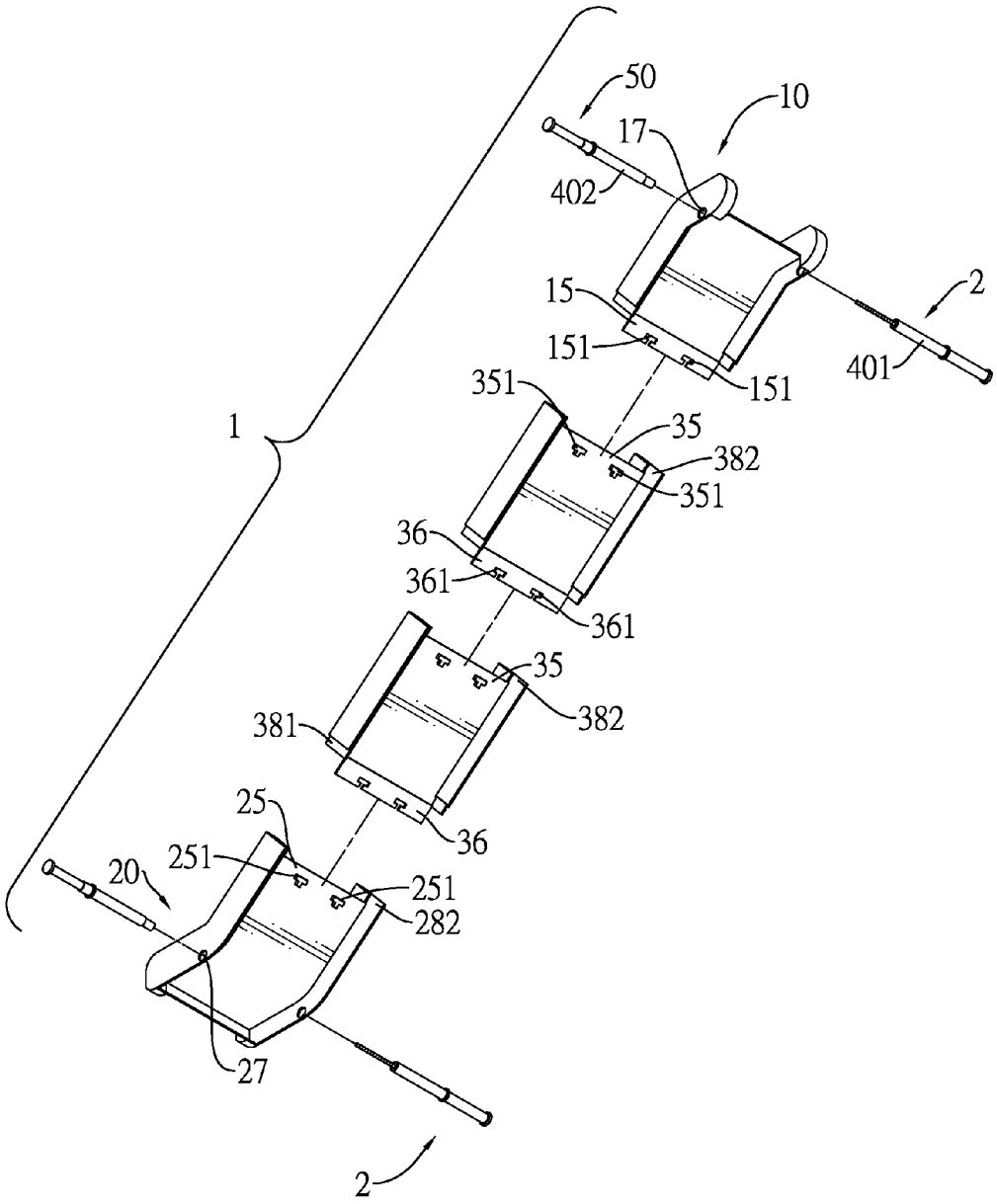
FIG. 3 is another exploded perspective view of the combination slide in FIG. 1.
Figure 4:
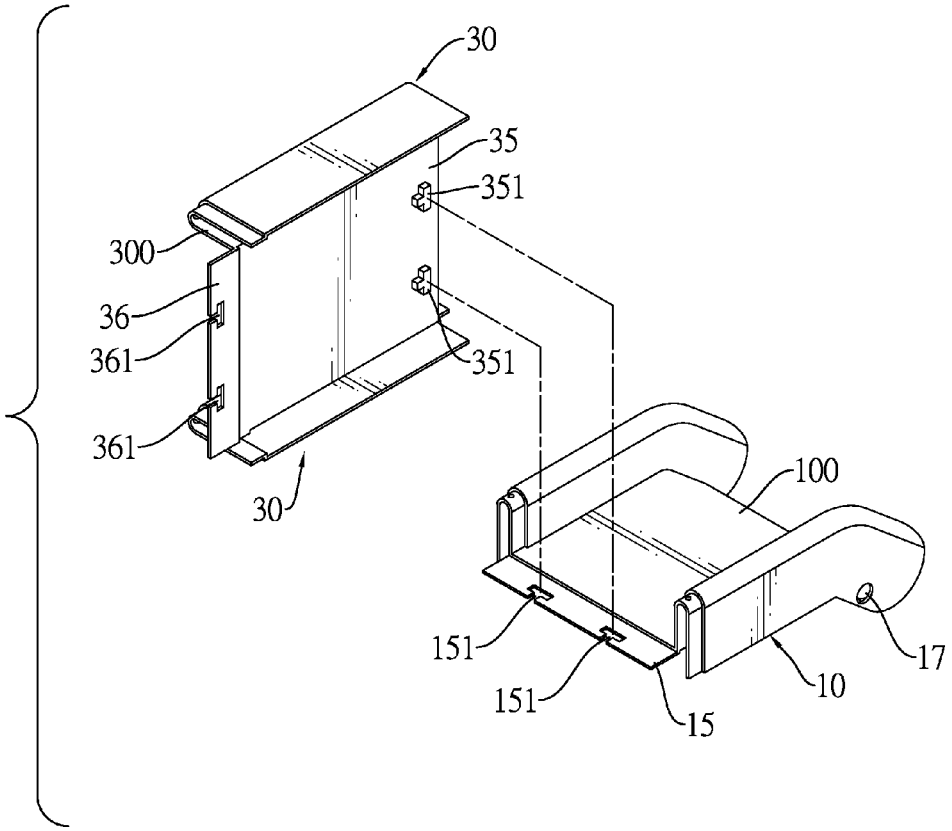
FIG. 4 is an exploded perspective view of a head member and a connecting member of the combination slide in FIG. 1.

With further reference to FIGS. 3 and 4, the connecting members 30 are connected detachably between the head member 10 and the tail member 20. Adjacent two of the connecting members 30 are connected detachably to each other. Each connecting member 30 has an intermediate sliding channel 300, two intermediate rails 38, two intermediate mounting protrusions 382, two intermediate mounting notches 381, an upper intermediate quick-release engaging element 35 and a lower intermediate quick-release engaging element 36.

The intermediate sliding channel 300 is defined in the connecting member 30 and communicates with one of the head sliding channel 100, the tail sliding channel 200 and the intermediate sliding channel 300 of an adjacent connecting member 30.

The intermediate rails 38 are formed on connecting member 30 such that the intermediate sliding channel 300 is located between the intermediate rails 38.

The intermediate mounting protrusions 382 are U-shaped, are formed on and protrude respectively from top ends of the intermediate rails 38. The intermediate mounting protrusions 382 of the connecting member 30 connecting to the head member 10 are detachably engaged respectively with the head mounting notches 181.

The intermediate mounting notches 381 are U-shaped, are defined respectively in bottom ends of the intermediate rails 38 and are detachably engaged respectively with the tail mounting protrusions 282 of the tail member 20 or respectively with the intermediate mounting protrusions 382 of an adjacent connecting member 30.

The upper intermediate quick-release engaging element 35 is formed on a top end of the connecting member 30 and may be a recess portion corresponding to the protruding portion. The upper intermediate quick-release engaging element 35 of the connecting member 30 connecting to the head member 10 is engaged detachably with the head quick-release engaging element 15. The upper intermediate quick-release engaging element 35 has multiple T-shaped engaging projections 351 formed on the upper intermediate quick-release engaging element 35. The T-shaped engaging projections 351 of the upper intermediate quick-release engaging element 35 of the connecting member 30 connecting to the head member 10 are detachably engaged respectively with the T-shaped engaging slots 151 of the head quick-release engaging element 15.

The lower intermediate quick-release engaging element 36 is formed on a bottom end of the connecting member 30, may be a protruding portion corresponding to the recess portion and is engage detachably with the tail quick-release engaging element 25 of the tail member 20 or the upper intermediate quick-release engaging element 35 of an adjacent connecting member 30. The lower intermediate quick-release engaging element 36 has multiple T-shaped engaging slots 361 defined through the lower intermediate quick-release engaging element 36 and detachably engaged respectively with the T-shaped projections 251 of the tail quick-release engaging element 25 of the tail member 20 or respectively with the T-shaped engaging projections 351 of the upper intermediate quick-release engaging element 35 of an adjacent connecting member 30.

The pressing rods 2 are telescopic, are mounted respectively on the head member 10 and the tail member 20 and are capable of pressing the combination slide against the staircase 90. Therefore, the combination slide is mounted securely on the staircase. The pressing rods 2 are mounted respectively through the upper assembling hole 17 and the lower assembling hole 27.

Figure 8:
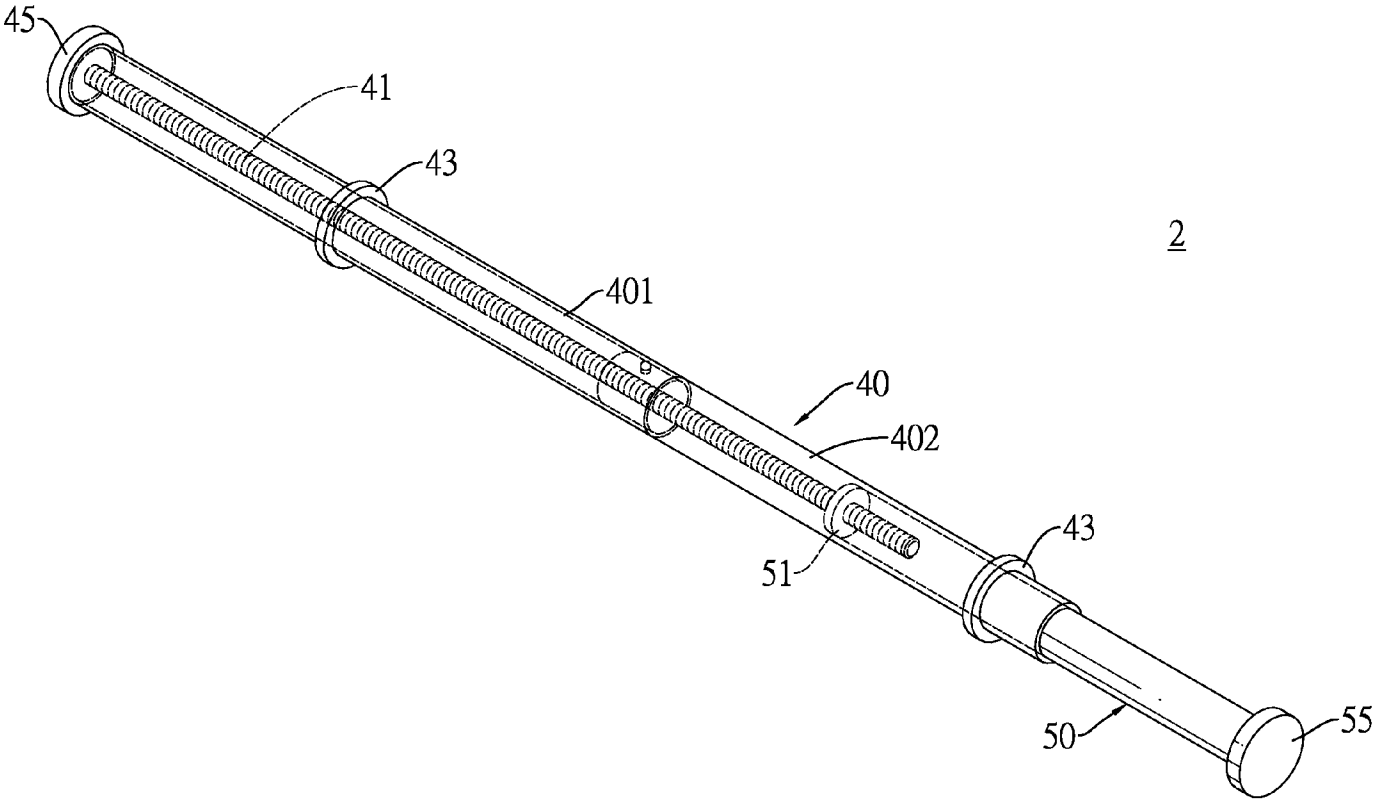
FIG. 8 is a perspective view of a pressing rod of the combination slide of the first, second and third embodiment.
Figure 9:
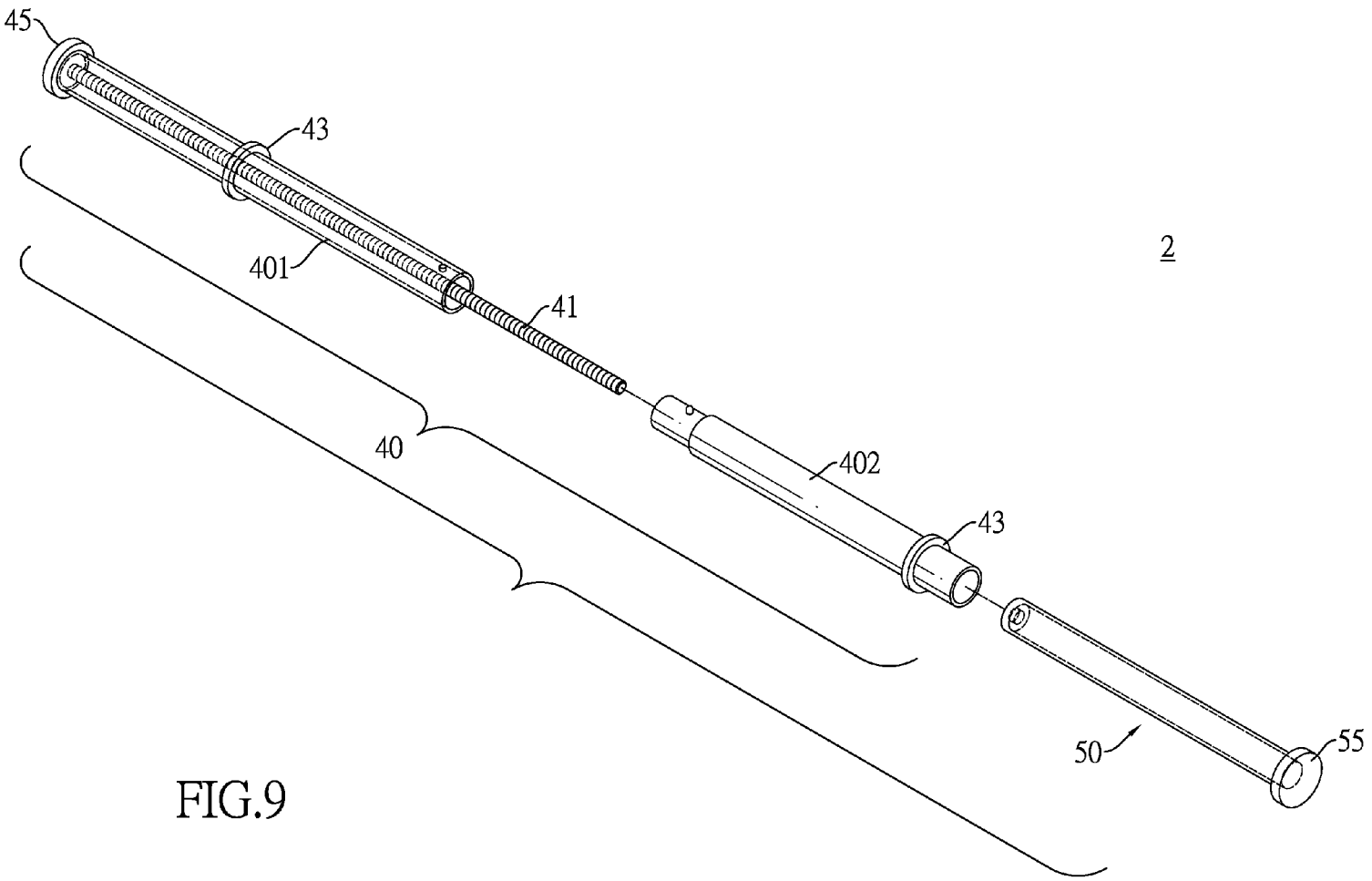
FIG. 9 is an exploded perspective view of the pressing rod in FIG. 8.

With further reference to FIGS. 8 and 9, each pressing rod 2 has an outer tube 40 and an inner tube 50.

The outer tube 40 has an outside tube portion 401, an intermediate tube portion 402, two abutment rings 43 and a screw 41.

The outside tube portion 401 is hollow and is mounted on one of two opposite sides of the head member 10 or the tail member 20, may be mounted in the upper assembling hole 17 or the lower assembling hole 27 and has a pressing end, a mounting hole 4011 and a pressing pad 45. The mounting hole 4011 is defined in the outside tube portion 401. The pressing pad 45 is mounted on the pressing end and may tightly press against the staircase 90.

The intermediate tube portion 402 is hollow, is mounted on the other side of the head member 10 or the tail member 20, may be mounted in the upper assembling hole 17 or the lower assembling hole 27, is mounted detachably in the mounting hole of the outside tube portion 401 and has a through hole 4021 defined through the intermediate tube portion 402.

The abutment rings 43 are respectively mounted around the outside tube portion 401 and the intermediate tube portion 402 and respectively abut the sides of the head member 10 or the tail member 20.

The screw 41 is mounted securely in the mounting hole 4011 of the outside tube portion 401 and extends in the through hole 4021 of the intermediate tube portion 402.

The inner tube 50 is mounted telescopically in the intermediate tube portion 402 of the outer tube 40 and has a pressing end, a connecting end, a nut 51 and a pressing pad 55. The nut 51 is mounted on the connecting end of the inner tube 50 and is engaged rotatably with the screw 41. The pressing pad 55 is mounted on the pressing end of the inner tube 50 and may tightly press against the staircase 90.

Figure 5:
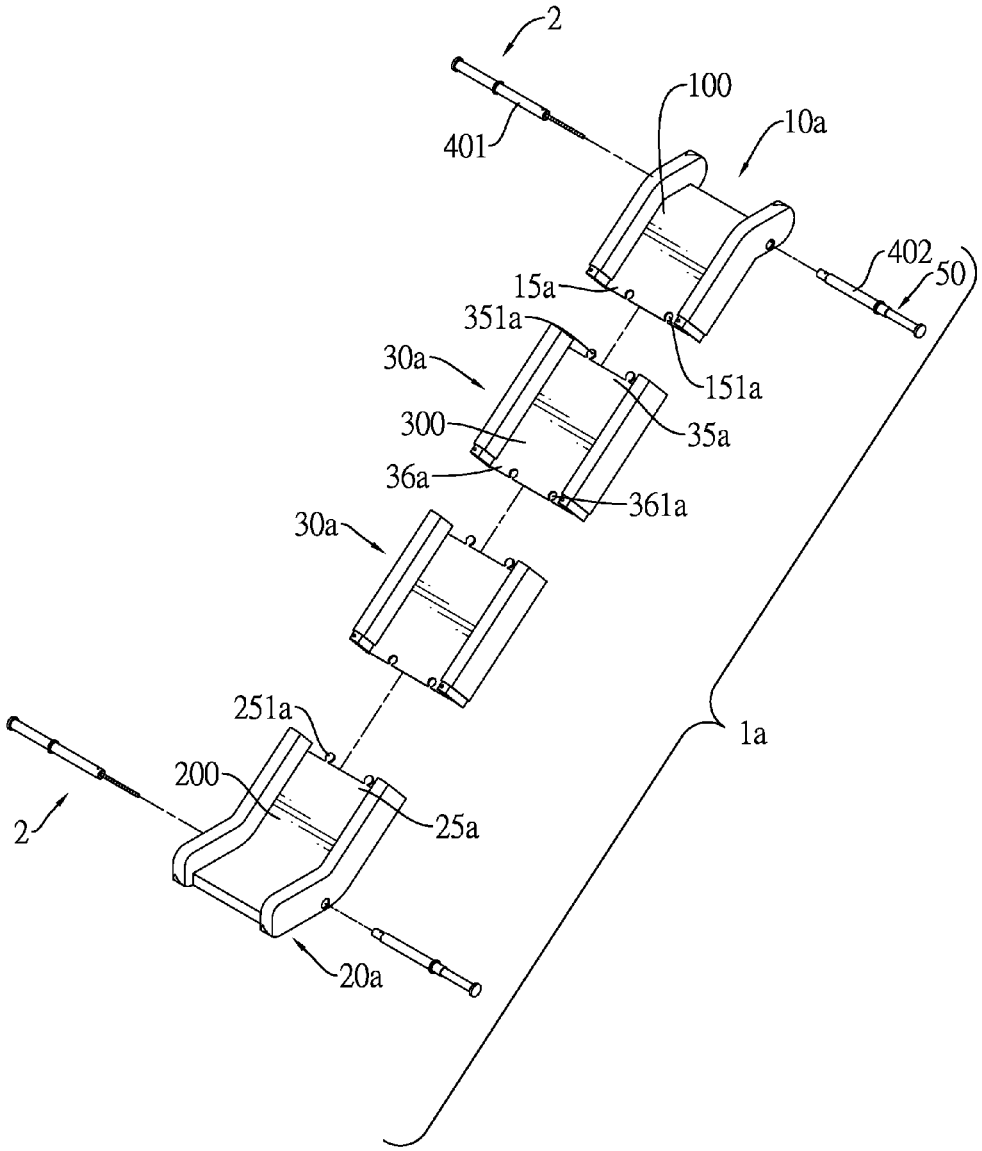
FIG. 5 is an exploded perspective view of a second embodiment of the combination slide in accordance with the present invention FIG. 6 an exploded perspective view of a head member and a connecting member of the combination slide in FIG. 5.
Figure 6:
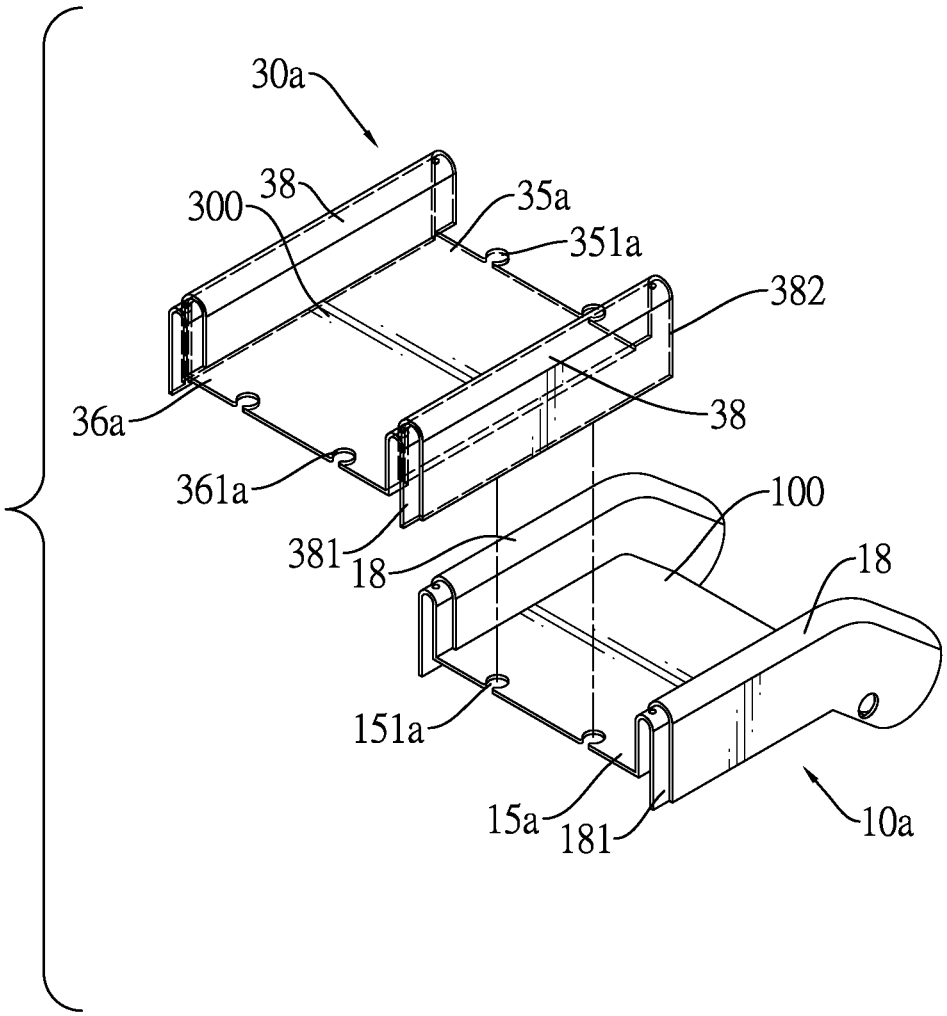

With further reference to FIGS. 5 and 6, a second embodiment of the combination slide in accordance with the present invention is similar to the first embodiment. The head quick-release engaging element 15*a* of the head member 10*a* of the second embodiment has multiple Ω-shaped engaging slots 151*a*. The tail quick-release engaging element 25*a* of the tail member 20*a* has multiple Ω-shaped engaging projections 251*a*. The upper intermediate quick-release engaging element 35 of each connecting member 30 has multiple Ω-shaped engaging projections 351*a* corresponding to the Ω-shaped engaging slots 151*a* and multiple Ω-shaped engaging slots 361*a* corresponding to the Ω-shaped engaging projections 251*a*, 351*a*.

Figure 7:
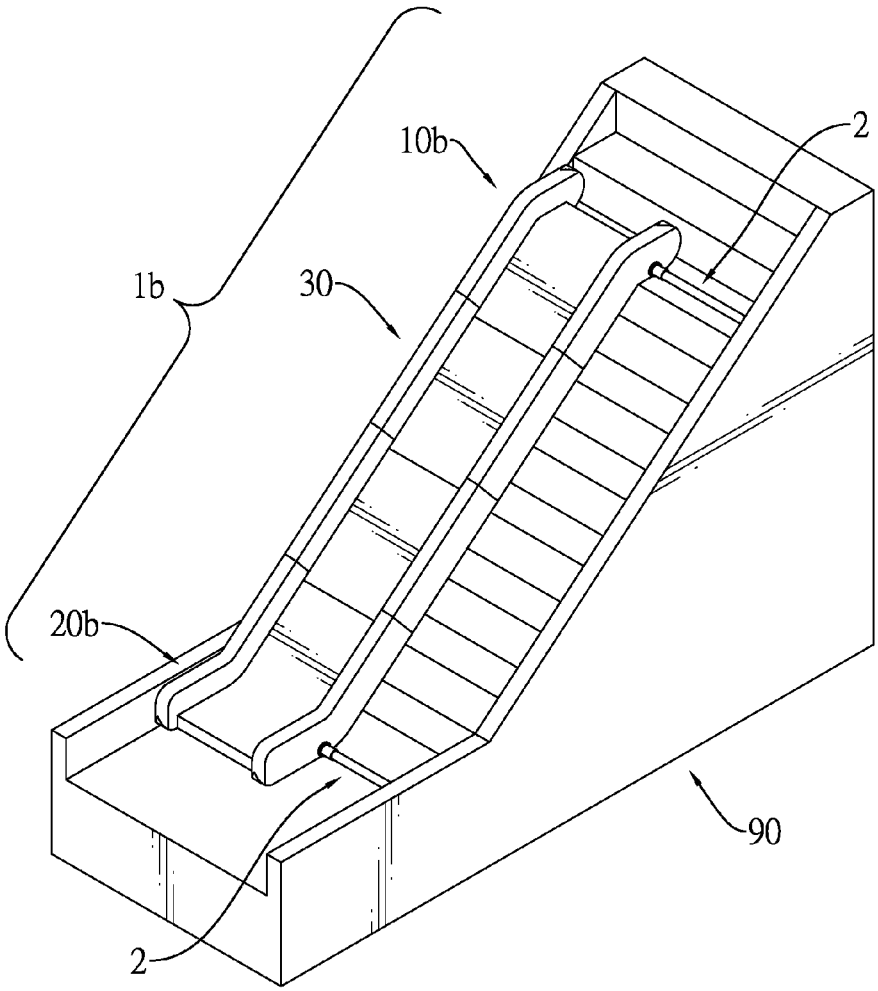
FIG. 7 is a perspective view of a third embodiment of the combination slide in accordance with the present invention set on a stair case.

With further reference to FIG. 7, a third embodiment of the combination slide in accordance with the present invention is similar to the first embodiment. However, the head member 10*b* and the tail member 20*b* of the third embodiment are implemented without assembling holes. The pressing rods 2 are implemented without abutment rings 43. The pressing pad 45 on the pressing end of the outer tube 40 tightly presses against one side of the head member 10*b* or the tail member 10*b*. The pressing tab 55 of the inner tube 50 tightly presses against the staircase 90.

The head member 10, tail member 20 and connecting member 30 may be connected or disconnected quickly through the head quick-release engaging element 15, quick-release engaging element 25, upper intermediate quick-release engaging element 35 and lower intermediate quick-release engaging element 36. Therefore, the combination slide may be assembled or disassembled quickly. Furthermore, pressing rods 2 press the combination slide tightly against the staircase 90, which prevents the combination slide from inadvertently slipping on the staircase 90.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A combination slide comprising:

a slide body being capable of being disassembled and having a head member having a head sliding channel defined in the head member; and a head quick-release engaging element formed on a bottom end of the head member;

a tail member having a tail sliding channel defined in the tail member; and a tail quick-release engaging element formed on a top end of the tail member; and multiple connecting members connected detachably between the head member and the tail member, adjacent two of the connecting members are connected detachably to each other, and each connecting member having an intermediate sliding channel defined in the connecting member and communicating with one of the head sliding channel, the tail sliding channel and the intermediate sliding channel of an adjacent connecting member;

an upper intermediate quick-release engaging element formed on a top end of the connecting member, wherein the upper intermediate quick-release engaging element of the connecting member connecting to the head member is engaged detachably with the head quick-release engaging element; and a lower intermediate quick-release engaging element formed on a bottom end of the connecting member and engaged detachably with the tail quick-release engaging element of the tail member or the upper intermediate quick-release engaging element of an adjacent connecting member; and two pressing rods being telescopic and mounted respectively on the head member and the tail member for pressing the combination slide against a staircase.

2. The combination slide as claimed in claim 1, wherein the head quick-release engaging element is a protruding portion;

the tail quick-release engaging element is a recess portion corresponding to the protruding portion;

each upper intermediate quick-release engaging element is a recess portion corresponding to the protruding portion; and each lower intermediate quick-release engaging element is a protruding portion corresponding to the recess portion.

3. The combination slide as claimed in claim 2, wherein the head quick-release engaging element has multiple T-shaped engaging slots defined through the head quick-release engaging element;

the tail quick-release engaging element has multiple T-shaped projections formed on the tail quick-release engaging element;

the upper intermediate quick-release engaging element of each connecting member has multiple T-shaped engaging projections formed on the upper intermediate quick-release engaging element; the T-shaped engaging projections of the upper intermediate quick-release engaging element of the connecting member connecting to the head member are detachably engaged respectively with the T-shaped engaging slots of the head quick-release engaging element; and the lower intermediate quick-release engaging element of each connecting member has multiple T-shaped engaging slots defined through the lower intermediate quick-release engaging element and detachably engaged respectively with the T-shaped projections of the tail quick-release engaging element of the tail member or respectively with the T-shaped engaging projections of the upper intermediate quick-release engaging element of an adjacent connecting member.

4. The combination slide as claimed in claim 3, wherein the head member has an upper assembling hole defined laterally through the head member;

the tail member has a lower assembling hole defined laterally through the tail member;

the pressing rods are mounted respectively through the upper assembling hole and the lower assembling hole and each pressing rod has an outer tube having an outside tube portion mounted on one of two opposite sides of the head member or the tail member, mounted in the upper assembling hole or the lower assembling hole and having a pressing end;

a mounting hole defined in the outside tube portion; and a pressing pad mounted on the pressing end;

an intermediate tube portion mounted on the other side of the head member or the tail member, mounted in the upper assembling hole or the lower assembling hole, mounted detachably in the mounting hole of the outside tube portion and having a through hole defined through the intermediate tube portion;

two abutment rings respectively mounted around the outside tube portion and the intermediate tube portion and respectively abutting the sides of the head member or the tail member; and a screw mounted securely in the mounting hole of the outside tube portion and extends in the through hole of the intermediate tube portion; and an inner tube mounted telescopically in the intermediate tube portion of the outer tube and having a pressing end;

a connecting end;

a nut mounted on the connecting end of the inner tube and is engaged rotatably with the screw; and a pressing pad mounted on the pressing end of the inner tube.

5. The combination slide as claimed in claim 3, wherein the pressing rods are mounted respectively through the upper assembling hole and the lower assembling hole and each pressing rod has an outer tube having an outside tube portion mounted on one of two opposite sides of the head member or the tail member and having a pressing end;

a mounting hole defined in the outside tube portion; and a pressing pad mounted on the pressing end and tightly presses against one side of the head member or the tail member;

an intermediate tube portion mounted on the other side of the head member or the tail member and having a through hole defined through the intermediate tube portion; and a screw mounted securely in the mounting hole of the outside tube portion and extends in the through hole of the intermediate tube portion; and an inner tube mounted telescopically in the intermediate tube portion of the outer tube and having
a pressing end;
a connecting end;
a nut mounted on the connecting end of the inner tube and is engaged rotatably with the screw; and
a pressing pad mounted on the pressing end of the inner tube.

6. The combination slide as claimed in claim 3, wherein
the head member has
two head rails formed respectively on opposite sides of the head member such that the head sliding channel is located between the head rails; and
two head mounting notches being U-shaped and defined respectively on top ends of the head rails;
the tail member has
two tail rails formed on the tail member so that the tail sliding channel is located between the tail rails; and
two tail mounting protrusions being U-shaped and formed on and protruding respectively from top ends of the tail rails
each connecting member has
two intermediate mounting protrusions being U-shaped, formed on and protruding respectively from top ends of the intermediate rails, wherein the intermediate mounting protrusions of the connecting member connecting to the head member are detachably engaged respectively with the head mounting notches; and
two intermediate mounting notches being U-shaped, defined respectively in bottom ends of the intermediate rails 38 and detachably engaged respectively with the tail mounting protrusions of the tail member or respectively with the intermediate mounting protrusions of an adjacent connecting member.

7. The combination slide as claimed in claim 2, wherein
the head quick-release engaging element has multiple Ω-shaped engaging slots defined through the head quick-release engaging element;
the tail quick-release engaging element has multiple Ω-shaped projections formed on the tail quick-release engaging element;
the upper intermediate quick-release engaging element of each connecting member has multiple Ω-shaped engaging projections formed on the upper intermediate quick-release engaging element; the Ω-shaped engaging projections of the upper intermediate quick-release engaging element of the connecting member connecting to the head member are detachably engaged respectively with the Ω-shaped engaging slots of the head quick-release engaging element; and
the lower intermediate quick-release engaging element of each connecting member has multiple Ω-shaped engaging slots defined through the lower intermediate quick-release engaging element and detachably engaged respectively with the Ω-shaped projections of the tail quick-release engaging element of the tail member or respectively with the Ω-shaped engaging projections of the upper intermediate quick-release engaging element of an adjacent connecting member.

8. The combination slide as claimed in claim 7, wherein
the head member has an upper assembling hole defined laterally through the head member;
the tail member has a lower assembling hole defined laterally through the tail member;
the pressing rods are mounted respectively through the upper assembling hole and the lower assembling hole and each pressing rod has
an outer tube having
an outside tube portion mounted on one of two opposite sides of the head member or the tail member, mounted in the upper assembling hole or the lower assembling hole and having
a pressing end;
a mounting hole defined in the outside tube portion; and
a pressing pad mounted on the pressing end;
an intermediate tube portion mounted on the other side of the head member or the tail member, mounted in the upper assembling hole or the lower assembling hole, mounted detachably in the mounting hole of the outside tube portion and having a through hole defined through the intermediate tube portion;
two abutment rings respectively mounted around the outside tube portion and the intermediate tube portion and respectively abutting the sides of the head member or the tail member; and
a screw mounted securely in the mounting hole of the outside tube portion and extends in the through hole of the intermediate tube portion; and
an inner tube mounted telescopically in the intermediate tube portion of the outer tube and having
a pressing end;
a connecting end;
a nut mounted on the connecting end of the inner tube and is engaged rotatably with the screw; and
a pressing pad mounted on the pressing end of the inner tube.

9. The combination slide as claimed in claim 7, wherein
the pressing rods are mounted respectively through the upper assembling hole and the lower assembling hole and each pressing rod has
an outer tube having
an outside tube portion mounted on one of two opposite sides of the head member or the tail member and having
a pressing end;
a mounting hole defined in the outside tube portion; and
a pressing pad mounted on the pressing end and tightly presses against one side of the head member or the tail member;
an intermediate tube portion mounted on the other side of the head member or the tail member and having a through hole defined through the intermediate tube portion; and
a screw mounted securely in the mounting hole of the outside tube portion and extends in the through hole of the intermediate tube portion; and
an inner tube mounted telescopically in the intermediate tube portion of the outer tube and having
a pressing end;
a connecting end;
a nut mounted on the connecting end of the inner tube and is engaged rotatably with the screw; and
a pressing pad mounted on the pressing end of the inner tube.

10. The combination slide as claimed in claim 7, wherein
the head member has
two head rails formed respectively on opposite sides of the head member such that the head sliding channel is located between the head rails; and
two head mounting notches being U-shaped and defined respectively on top ends of the head rails;

the tail member has two tail rails formed on the tail member so that the tail sliding channel is located between the tail rails; and two tail mounting protrusions being U-shaped and formed on and protruding respectively from top ends of the tail rails each connecting member has two intermediate mounting protrusions being U-shaped, formed on and protruding respectively from top ends of the intermediate rails, wherein the intermediate mounting protrusions of the connecting member connecting to the head member are detachably engaged respectively with the head mounting notches; and two intermediate mounting notches being U-shaped, defined respectively in bottom ends of the intermediate rails 38 and detachably engaged respectively with the tail mounting protrusions of the tail member or respectively with the intermediate mounting protrusions of an adjacent connecting member.

* * * * *